US008939311B2

(12) United States Patent
Christopoulos et al.

(10) Patent No.: US 8,939,311 B2
(45) Date of Patent: Jan. 27, 2015

(54) BEVERAGE CONTAINER WITH RECESSED TOP AND METHOD FOR USING SAME

(71) Applicant: Mideas Inc., Costa Mesa, CA (US)

(72) Inventors: James Christopoulos, Tustin, CA (US); Martin Todd Belle, Tustin, CA (US); David Huang, Torrance, CA (US)

(73) Assignee: Mideas, LLC, Costa Mesa, CA (US)

( * ) Notice: Subject to any disclaimer, the term of this patent is extended or adjusted under 35 U.S.C. 154(b) by 128 days.

(21) Appl. No.: 13/669,363

(22) Filed: Nov. 5, 2012

(65) Prior Publication Data

US 2014/0124509 A1 May 8, 2014

(51) Int. Cl.
*B65D 1/24* (2006.01)

(52) U.S. Cl.
USPC ..... 220/521; 215/6

(58) Field of Classification Search
CPC .... B65D 51/247; B65D 51/246; B65D 51/28; B65D 81/3205; B65D 81/32
USPC ..... 220/521, 522; 215/6, 10
See application file for complete search history.

(56) References Cited

U.S. PATENT DOCUMENTS

| | | | | | |
|---|---|---|---|---|---|
| 933,302 | A | * | 9/1909 | Hartwell | 220/522 |
| 2,734,625 | A | * | 2/1956 | Nelson | 206/568 |
| 2,766,796 | A | * | 10/1956 | Tupper | 220/521 |
| 3,047,199 | A | * | 7/1962 | McBain | 229/120.32 |
| 3,537,610 | A | * | 11/1970 | Bilon | 220/258.4 |
| 3,743,520 | A | * | 7/1973 | Croner | 426/87 |
| 3,779,372 | A | * | 12/1973 | de Lloret | 206/222 |
| 3,955,742 | A | * | 5/1976 | Marshall et al. | 220/574 |
| 4,091,953 | A | * | 5/1978 | Daenen | 220/23.86 |
| 4,277,000 | A | * | 7/1981 | Jaarsma | 222/142.4 |
| 4,386,696 | A | * | 6/1983 | Goncalves | 206/221 |
| 4,475,654 | A | * | 10/1984 | Fruchter | 206/538 |
| 4,495,654 | A | * | 1/1985 | Deiss | 455/151.2 |
| 4,636,328 | A | * | 1/1987 | Flynn et al. | 510/277 |
| 4,720,351 | A | * | 1/1988 | Flynn et al. | 510/277 |
| 5,207,341 | A | | 5/1993 | Yeager | |
| 5,318,183 | A | * | 6/1994 | Cohen et al. | 206/538 |
| 5,443,175 | A | | 8/1995 | Kelly | |
| 5,515,991 | A | * | 5/1996 | Heitland | 220/256.1 |
| 6,085,927 | A | * | 7/2000 | Kusz | 220/23.87 |
| 6,202,880 | B1 | | 3/2001 | Strube | |
| 6,243,936 | B1 | * | 6/2001 | Biesecker et al. | 29/447 |

(Continued)

FOREIGN PATENT DOCUMENTS

JP 2004075087 A * 3/2004 ..... B65D 8/04

OTHER PUBLICATIONS

International Search Report and Written Opinion issued on Mar. 27, 2014 in related PCT/US2013/067715 application.

*Primary Examiner* — Steven A. Reynolds
*Assistant Examiner* — King M Chu
(74) *Attorney, Agent, or Firm* — Brennan C. Swain, Esq.; Jeffer Mangels Butler & Mitchell LLP

(57) ABSTRACT

A beverage container that includes a cylindrical main body portion having an open top and a closed bottom and that defines an interior. The bottom includes a contact surface and a continuous concave non-contact portion extending therebetween. The cylindrical main body portion defines a first volume. The container also includes a removable cover positioned at a location between the bottom and the top, and a recess defined between the removable cover and the open top. The recess defines a second volume that is between about 5% and about 50% of the first volume.

18 Claims, 11 Drawing Sheets

(56) References Cited

U.S. PATENT DOCUMENTS

| | | | | |
|---|---|---|---|---|
| 6,478,155 | B2 * | 11/2002 | Bunyan | 206/538 |
| 7,934,624 | B2 * | 5/2011 | Seelhofer | 222/129 |
| 7,946,452 | B2 * | 5/2011 | Hantman et al. | 222/94 |
| 7,967,135 | B2 | 6/2011 | Boatner | |
| 2002/0139709 | A1 * | 10/2002 | Bunyan | 206/538 |
| 2004/0045969 | A1 * | 3/2004 | Chiang | 220/521 |
| 2008/0017642 | A1 * | 1/2008 | King | 220/285 |
| 2009/0022861 | A1 * | 1/2009 | Caunter et al. | 426/131 |
| 2011/0056945 | A1 | 3/2011 | Ramsey | |
| 2012/0269934 | A1 | 10/2012 | Ramsey | |

* cited by examiner

BEVERAGE CONTAINER WITH RECESSED TOP AND METHOD FOR USING SAME

FIELD OF THE INVENTION

The present invention relates to a beverage container, and more particularly to a beverage container with a recessed top and the method for using the beverage container.

BACKGROUND OF THE INVENTION

To keep a beverage cool after opening a can, a user typically has to pour the contents into a cup or glass with ice therein or put an unfinished can into an ice chest or refrigerator where it risks being spilled. This can be a inconvenient for the user and promotes waste as it requires the use of materials for the can and for the cup or the use of soap and water to wash the non-disposable glassware.

SUMMARY OF THE PREFERRED EMBODIMENTS

In accordance with a first aspect of the present invention there is provided a beverage container that includes a cylindrical main body portion having an open top and a closed bottom and that defines an interior. The bottom includes a contact surface and a continuous concave non-contact portion extending therebetween. The cylindrical main body portion defines a first volume. The container also includes a removable cover positioned at a location between the bottom and the top, and a recess defined between the removable cover and the open top. The recess defines a second volume that is between about 5% and about 50% of the first volume. In a preferred embodiment, the cylindrical main body portion includes a rim disposed adjacent the top, wherein the rim has a diameter that is greater than or equal to the diameter of the top of the cylindrical main body portion. Preferably, the non-contact portion does not include a convex portion. However, this is not a limitation on the present invention.

In a preferred embodiment, the cylindrical main body portion includes a ledge disposed on an inside surface thereof that has at least one notch defined therein. The removable cover includes at least one tab sized to fit through the notch. In a closed position, at least a portion of the tab extends under the ledge. The removable cover includes a cylindrical wall extending upwardly therefrom and a handle extending between opposing walls of the cylindrical wall. In another embodiment, the removable cover comprises a ring and fully removable lid. In another embodiment, the cylindrical main body portion includes threads on an inside surface thereof and the removable cover includes a cylindrical wall extending upwardly therefrom that has threads on an outside surface thereof that are matingly engaged with the threads on the cylindrical main body portion, and the cylindrical main body portion includes a ledge disposed on an inside surface thereof. The removable cover is in a sealing relationship with a top surface of the ledge. In another embodiment, the removable cover includes a tab and a stay on lid, and the tab includes a pull portion and a lever portion that engages the stay on lid. In a preferred embodiment, the removable cover is positioned at a location such that a standard volume of beverage can fill the first volume below the removable cover, and the second volume or recess is at least 20 mL.

In a preferred embodiment, the removable cover further includes a secondary container that includes a removable mid associated therewith. Preferably, the cylindrical main body portion includes a first beverage and the secondary container includes a second beverage, and the first and second beverages are separated by the removable lid.

In accordance with another aspect of the present invention there is provided a method that includes providing a beverage container that includes a cylindrical main body portion having an open top, a closed bottom and an interior that defines a first volume, a removable cover positioned at a location between the bottom and the open top, and a recess defined between the removable cover and the top of the cylindrical main body portion that defines a second volume. The beverage container includes a first beverage disposed therein that fills a third volume below the removable cover. The method also includes removing the removable cover, placing a second beverage into the interior such that the first and second beverages fill the third volume and at least a portion of the second volume.

In a preferred embodiment, the removable cover further includes a secondary container that includes the second beverage and has a removable lid, and the method includes removing the removable lid before placing the second beverage into the interior.

The invention, together with additional features and advantages thereof, may be best understood by reference to the following description.

DETAILED DESCRIPTION OF THE PREFERRED EMBODIMENTS

Figure 1:
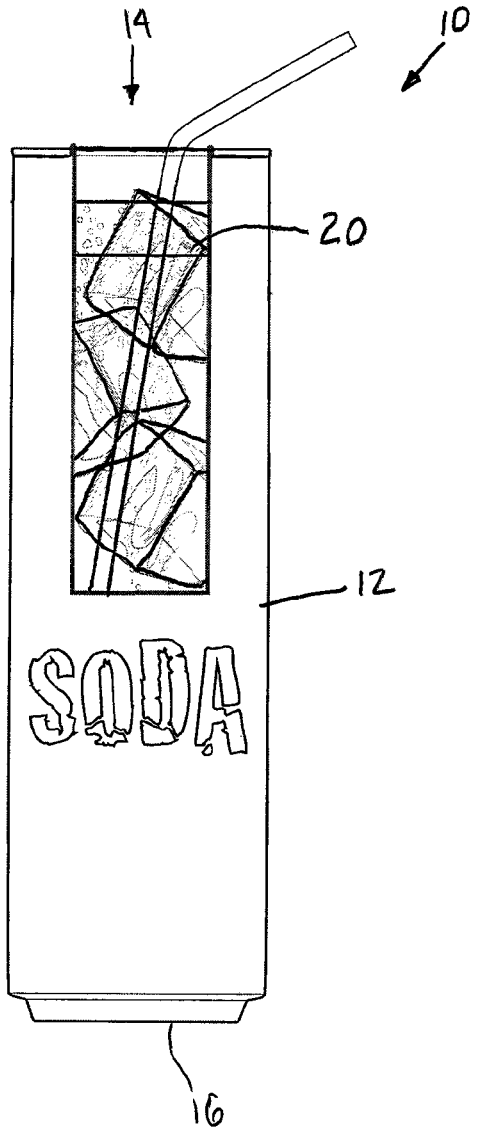
FIG. 1 is a side elevational view of a beverage container having a portion cut away to show liquid and ice therein in accordance with a preferred embodiment of the present invention.
Figure 2:
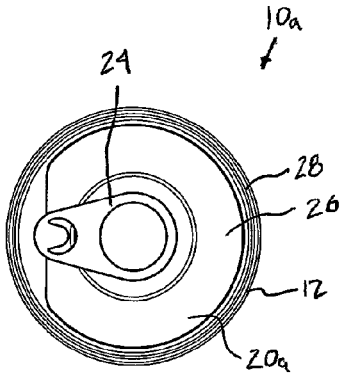
FIG. 2 is a top plan view of the beverage container of FIG. 1.
Figure 3:
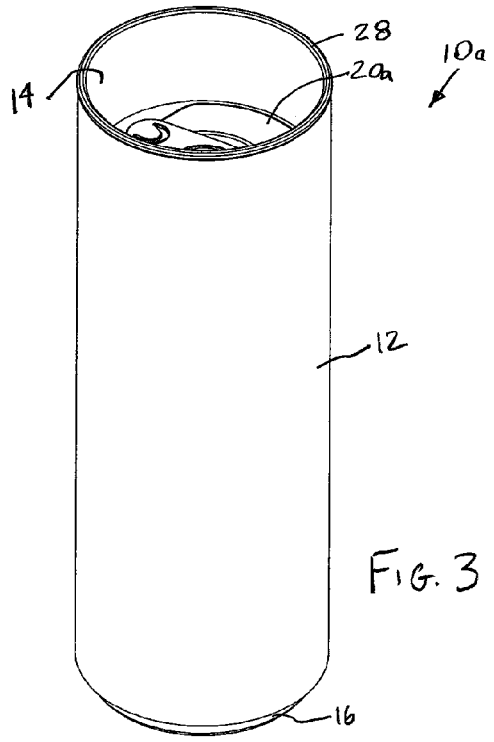
FIG. 3 is a top perspective view of the beverage container of FIG. 1.
Figure 4:
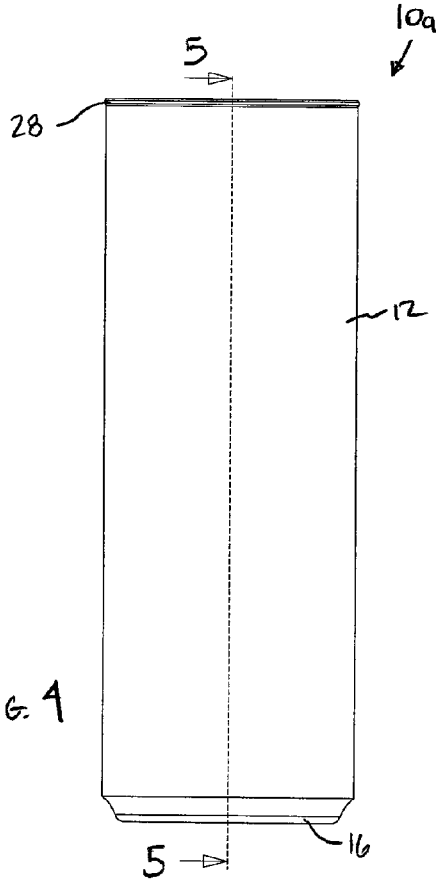
FIG. 4 is a side elevational view of the beverage container of FIG. 1.

The following description and drawings are illustrative and are not to be construed as limiting. Numerous specific details are described to provide a thorough understanding of the disclosure. However, in certain instances, well-known or conventional details are not described in order to avoid obscuring the description. References to one or an other embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. Appearances of the phrase "in one embodiment" in various places in the specification do not necessarily refer to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," and "below" used herein are merely for ease of description and refer to the orientation of the components as shown in the figures. It should be understood that any orientation of the components described herein is within the scope of the present invention.

Referring now to the drawings, wherein the showings are for purposes of illustrating the present invention and not for purposes of limiting the same, FIGS. 1-22 show several embodiments of beverage containers (generally referred to herein as 10 and individually referred to or designated as 10*a*, 10*b*, 10*c*, 10*d* and 10*e* in the figures) that each include a cylindrical main body portion 12 having an open top 14, a closed bottom 16, an interior 18, and a recessed removable cover 20 positioned at a location between the bottom 16 and the top 14. A recess 22 is defined between the removable cover 20 and the top of the cylindrical main body portion 12. Generally, in use, a standard volume of beverage fills the volume below the removable cover 20. A user can then remove the removable cover 20 and place other items, such as alcohol, ice or other mixer into the container 10 without overflowing the container 10. For example, a standard volume for a can or beverage container is twelve fluid ounces. In an exemplary embodiment, the beverage container has a volume that can hold sixteen fluid ounces, but only includes twelve fluid ounces of cola therein. In use, a user removes the removable cover 20 and then pours three fluid ounces of whiskey therein to provide a whiskey and cola in the original cola container. In a preferred embodiment, the recess or extra space is between about 5% and about 50% of the total volume. In a more preferred embodiment, the recess or extra space is between about 10% and about 40% of the total volume. In the most preferred embodiment, the recess or extra space is between about 20% and about 30% of the total volume.

FIGS. 2-6 show a first embodiment of a beverage container 10*a*. As shown in FIGS. 2-6, container 10*a* includes a pull tab removable cover 20*a* or full-top pull-tab that includes a ring 24 connected to a fully removable lid 26, similar to the removable cover on a tennis ball can. Also see U.S. Pat. No. 3,349,949, the entirety of which is incorporated by reference herein.

Figure 5:
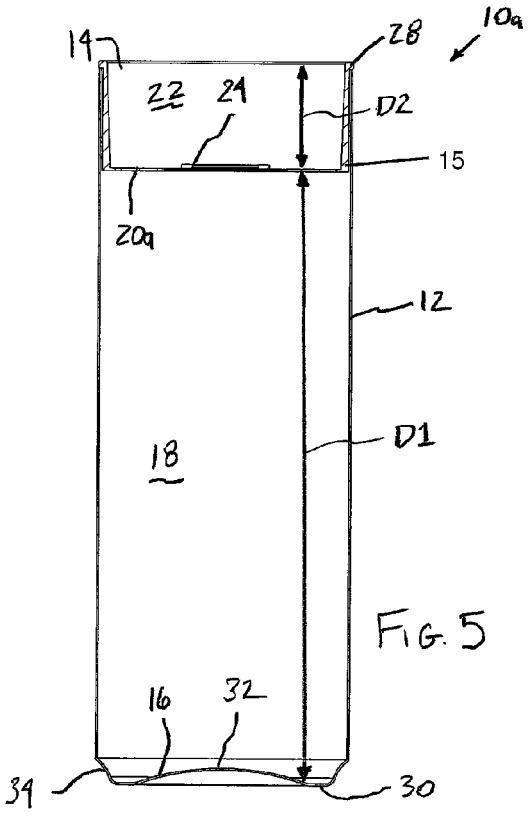
FIG. 5 is a cross sectional view of the beverage container of FIG. 1 taken along line 5-5 of FIG. 4.

As shown in FIG. 5, in a preferred embodiment, the container 10*a* includes a rim 28 that has an outer circumference that is the same or larger than the outer circumference of the cylindrical main body portion 12. It will be appreciated by those skilled in the art that the beverage container 10 with a rim 28 with an outer circumference about the same as the circumference of the cylindrical main body portion 12 (thereby providing relatively straight sides), and the recess 22 provides a more cup-like or glass-like feel when drinking from the beverage container 10. It will be appreciated that, as used herein, "removable cover" means that at least a portion of the removable cover can be removed or otherwise displaced so that the contents of the container 10 can be accessed. The container 10*a* can be manufactured such that the rim 28 and removable cover 20*a* are a unitary piece that at least partially define the recess 22. However, this is not a limitation on the present invention and the rim 28 and removable cover 20*a* can be separate components.

Figure 6:
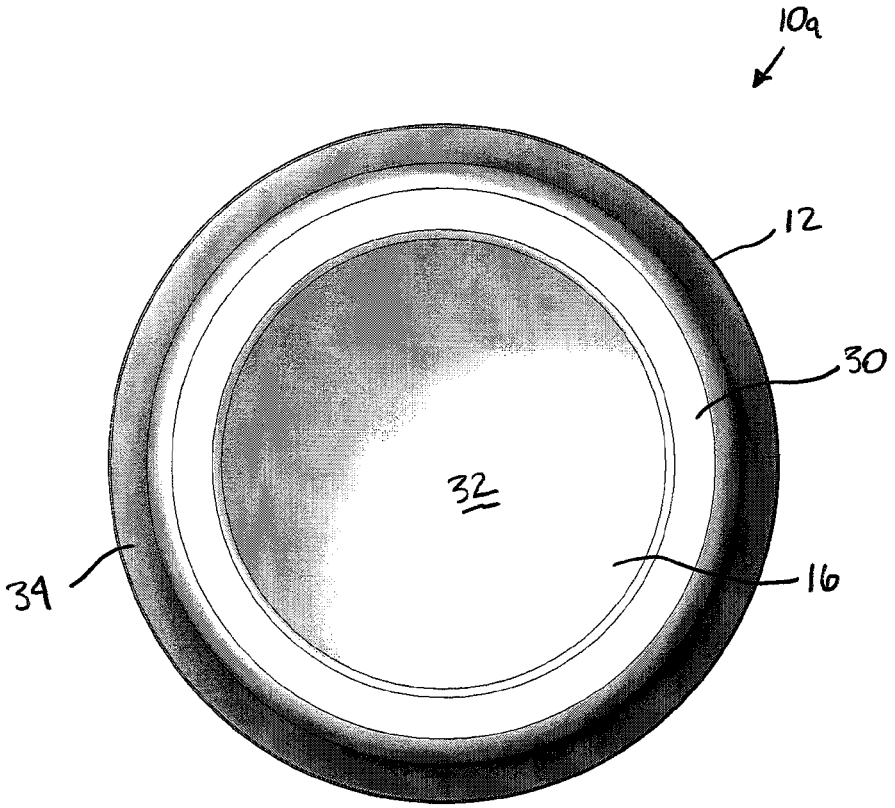
FIG. 6 is a bottom plan view of the beverage container of FIG. 1.

As shown in FIGS. 5-6, in a preferred embodiment, the bottom 16 includes a circular contact surface 30 that surrounds a non-contact portion 32 extending therebetween. In a preferred embodiment, the non-contact portion 32 has a continuous concave shape, as shown in FIG. 5. In another embodiment, the bottom 16 can include a rim and a flat bottom surface, similar to a can of beans or the like. The bottom 16 can also include a bevel 34, however, this is not a limitation on the present invention.

Figure 7:
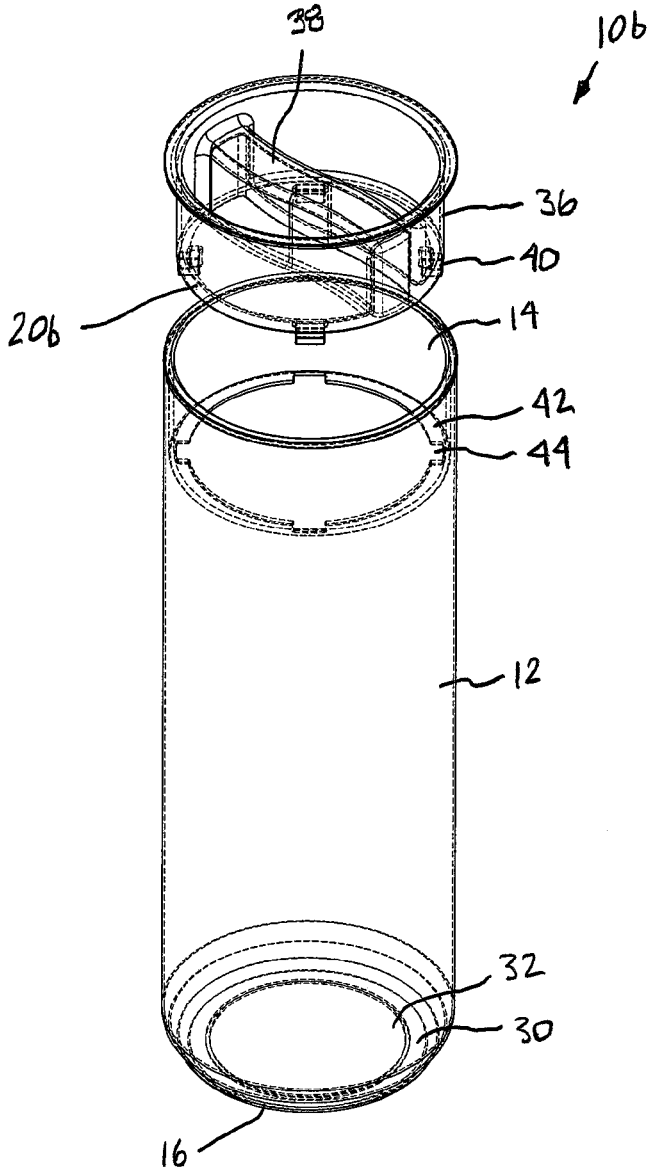
FIG. 7 is an exploded perspective view of a beverage container in accordance with another preferred embodiment of the present invention.
Figure 8:
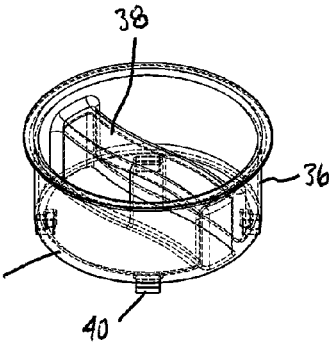
FIG. 8 is a perspective view of the cover assembly from the beverage container of FIG. 7.
Figure 9:
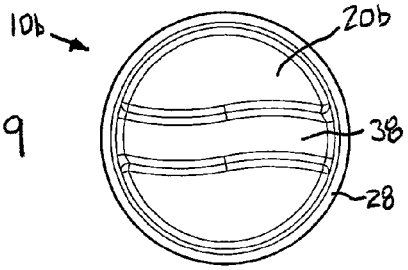
FIG. 9 is a top plan view of the beverage container of FIG. 7.
Figure 10:
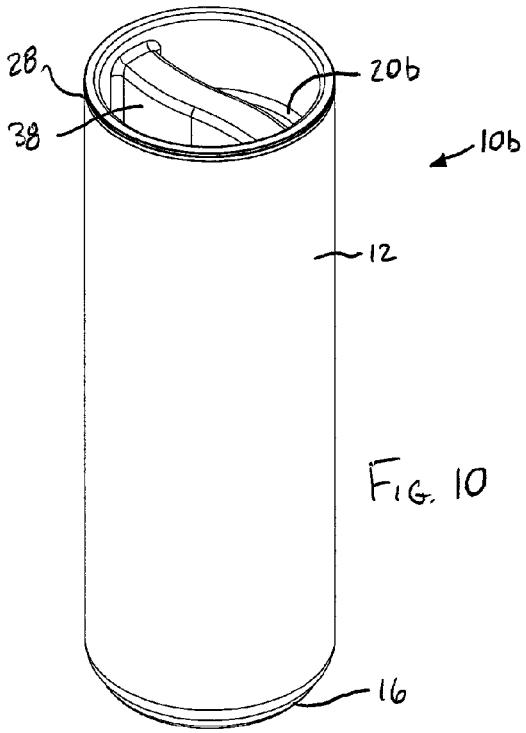
FIG. 10 is a top perspective view of the beverage container of FIG. 7.
Figure 11:
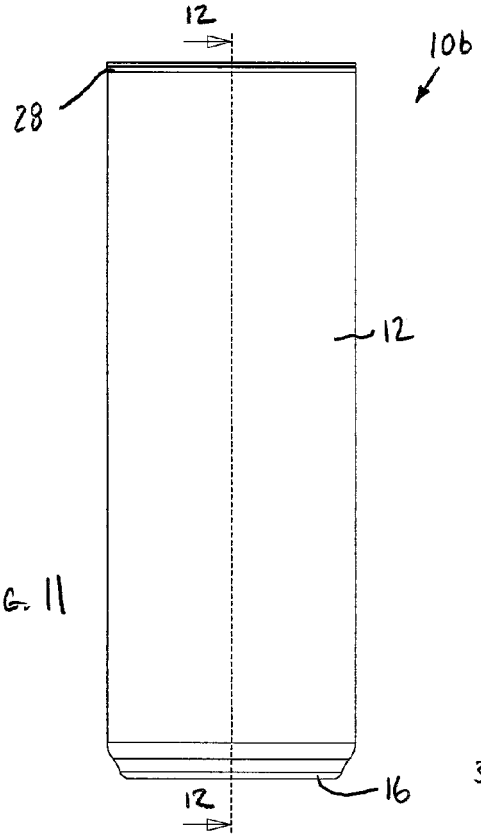
FIG. 11 is a side elevational view of the beverage container of FIG. 7.
Figure 12:
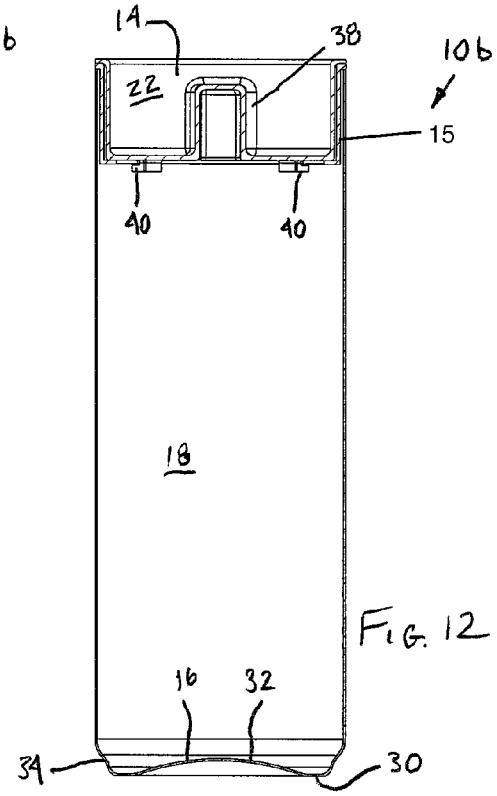
FIG. 12 is a cross sectional view of the beverage container of FIG. 7 taken along line 12-12 of FIG. 11.

FIGS. 7-12 show a second embodiment of a beverage container 10*b*. As shown in FIGS. 7-8, the removable cover 20*b* includes a cylindrical wall 36, a handle 38 and a plurality of tabs 40 that mate with a ledge 42 and corresponding notches 44 defined in the ledge 42. The ledge 42 is disposed on the interior surface of the cylindrical main body portion 12. Tabs 40 are received through notches 44 and then the removable cover 20*b* is rotated such that the tabs 40 are positioned under ledge 42, thereby securing the removable cover 20*b* on cylindrical main body portion 12, as shown in FIG. 12. In a preferred embodiment, a seal is positioned between removable cover 20*b* and ledge 42. It will be appreciated that this embodiment can be resealable.

Figure 13:
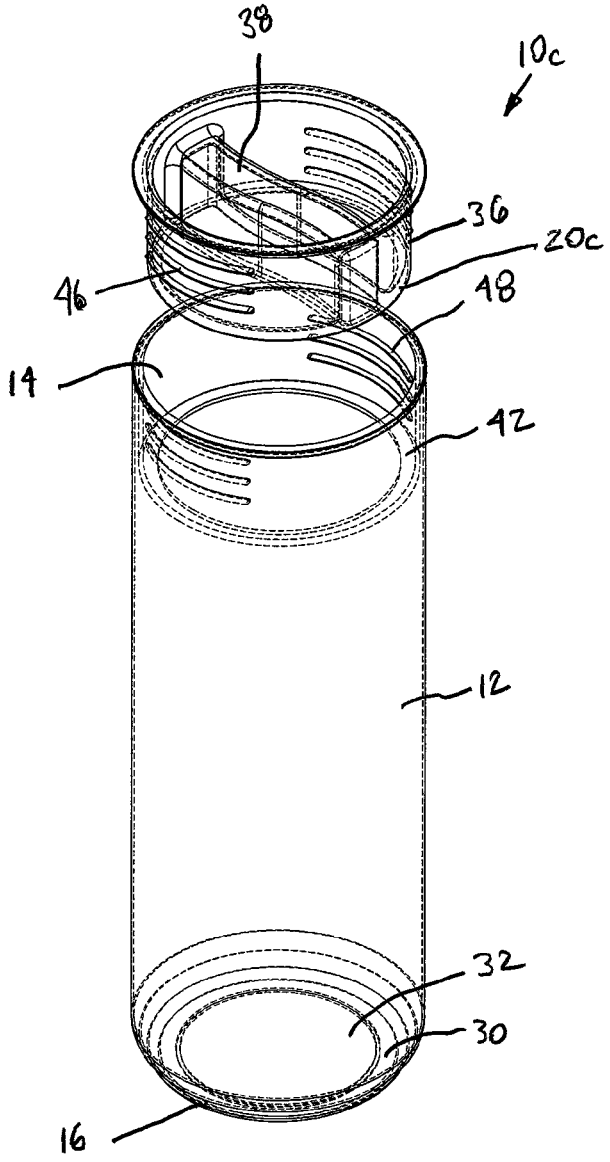
FIG. 13 is an exploded perspective view of a beverage container in accordance with another preferred embodiment of the present invention.
Figure 14:
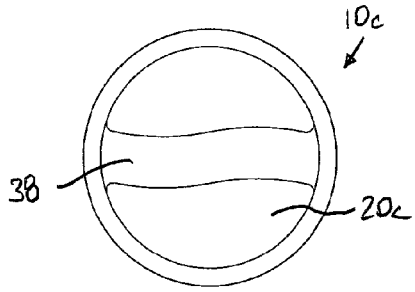
FIG. 14 is a top plan view of the beverage container of FIG. 13.
Figure 15:
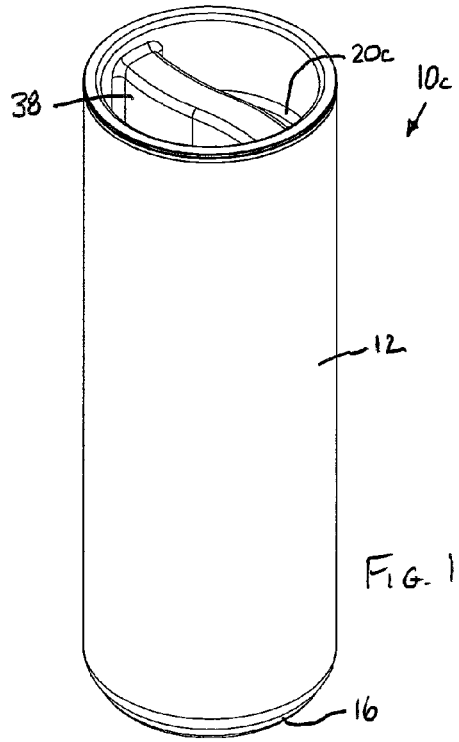
FIG. 15 is a top perspective view of the beverage container of FIG. 13.
Figure 16:
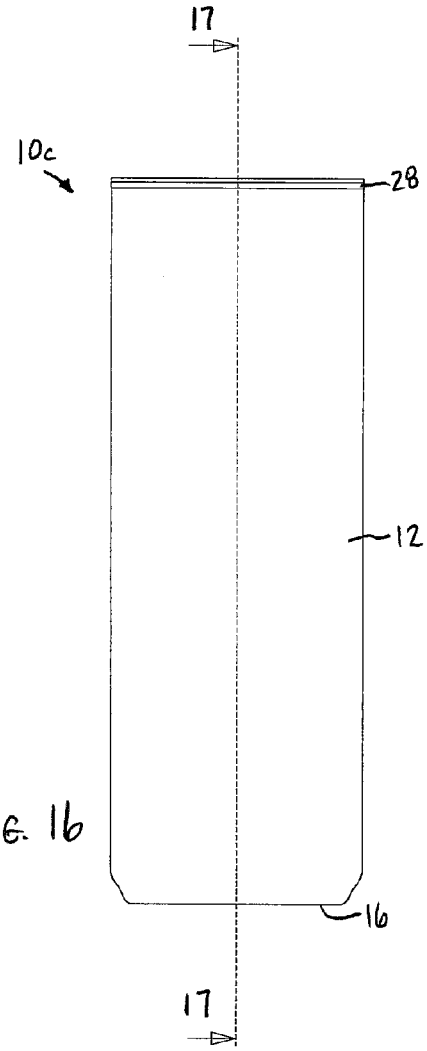
FIG. 16 is a side elevational view of the beverage container of FIG. 13.
Figure 17:
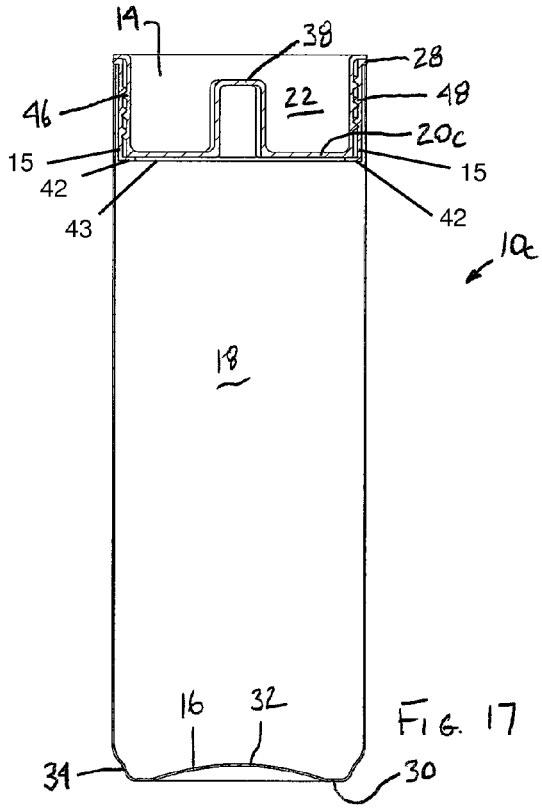
FIG. 17 is a cross sectional view of the beverage container of FIG. 13 taken along line 17-17 of FIG. 16.
Figure 18:
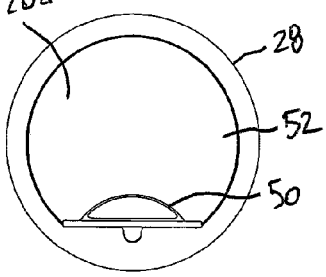
FIG. 18 is a top plan view of a beverage container in accordance with another preferred embodiment of the present invention.

FIGS. 13-17 show a third embodiment of a beverage container 10*c*. As shown in FIG. 13, removable cover 20*c* includes threads 46 that mate with corresponding threads 48 on the interior surface of the cylindrical main body portion 12. In a preferred embodiment, beverage container 10*c* includes ledge 42 to provide a sealing surface with removable cover 20*c*. However, this is not a limitation and ledge 42 can be omitted. It will be appreciated that this embodiment can be resealable.

Figure 19:
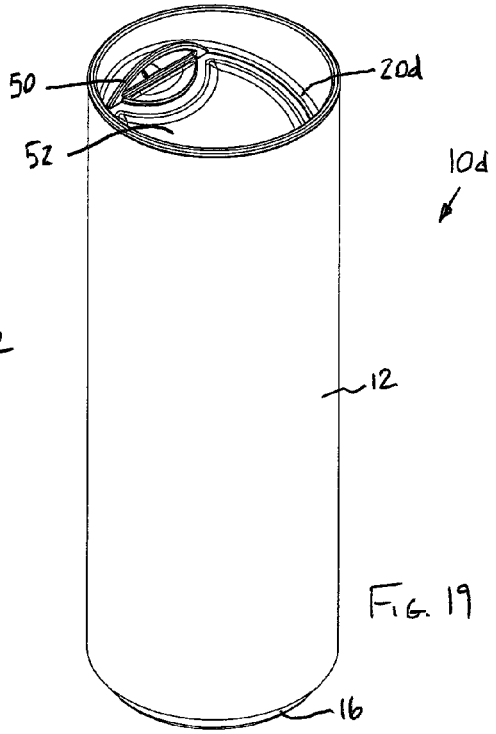
FIG. 19 is a top perspective view of the beverage container of FIG. 18.
Figure 20:
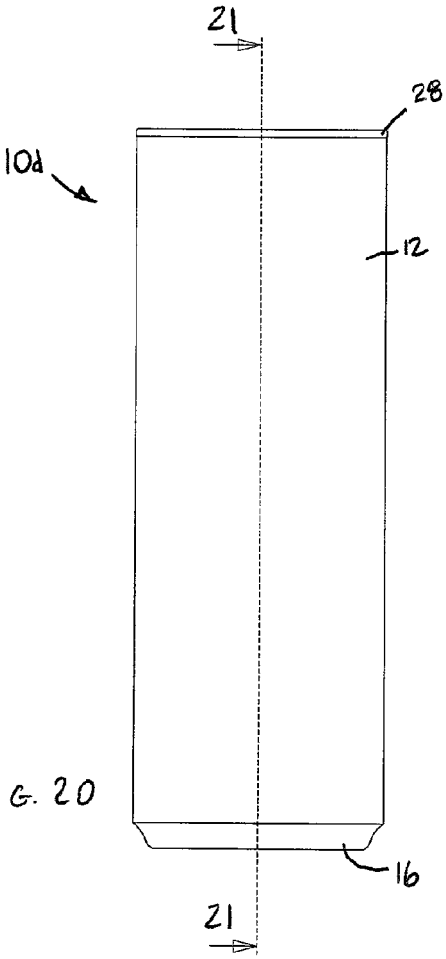
FIG. 20 is a side elevational view of the beverage container of FIG. 18.
Figure 21:
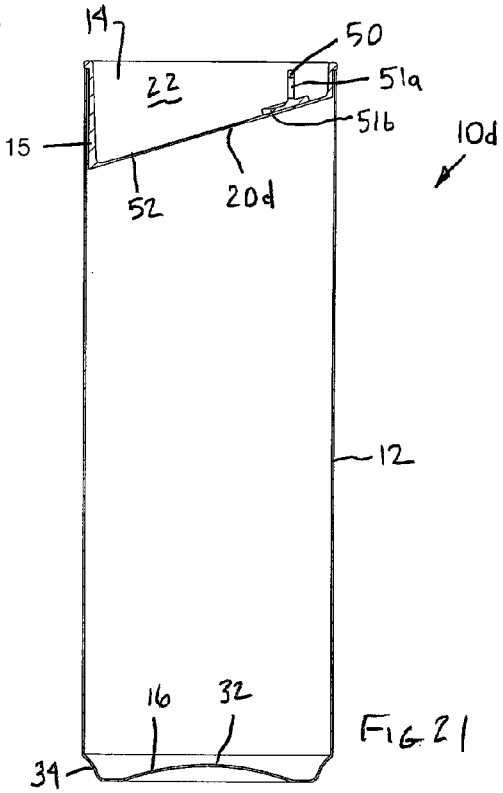
FIG. 21 is a cross sectional view of the beverage container of FIG. 18 taken along line 21-21 of FIG. 20.
Figure 22:
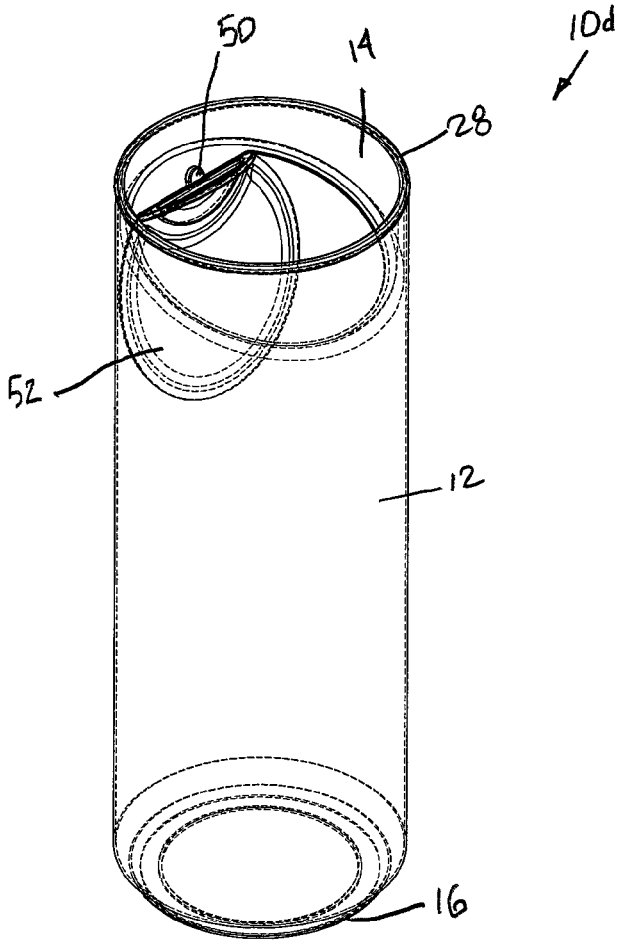
FIG. 22 is a top perspective view of the beverage container of FIG. 18 with the lid in the open position.
Figure 23:
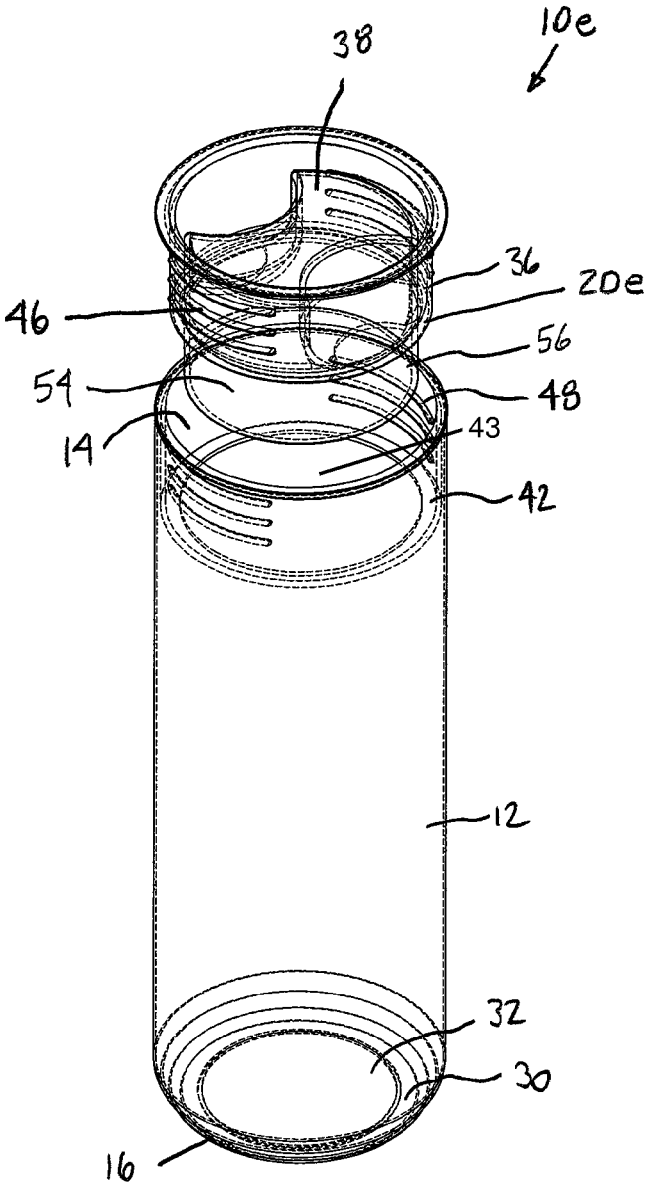
FIG. 23 is an exploded perspective view of a beverage container in accordance with another preferred embodiment of the present invention.
Figure 24:
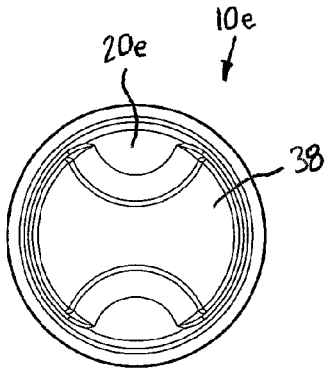
FIG. 24 is a top plan view of the beverage container of FIG. 23.
Figure 25:
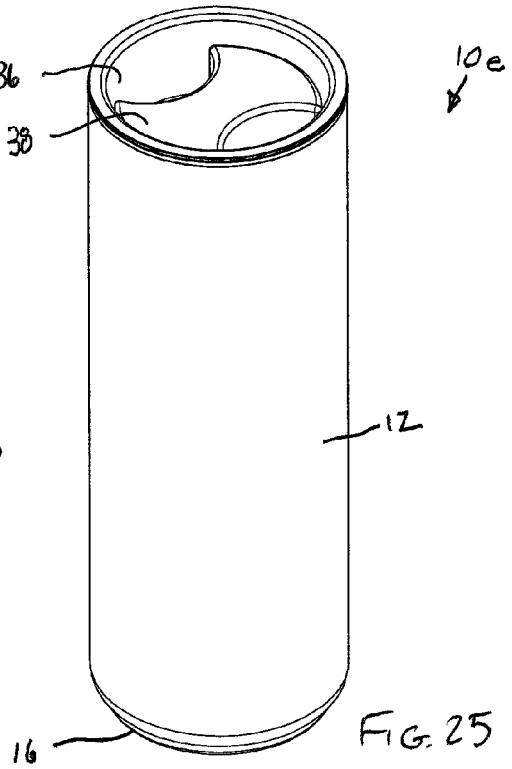
FIG. 25 is a top perspective view of the beverage container of FIG. 23.
Figure 26:
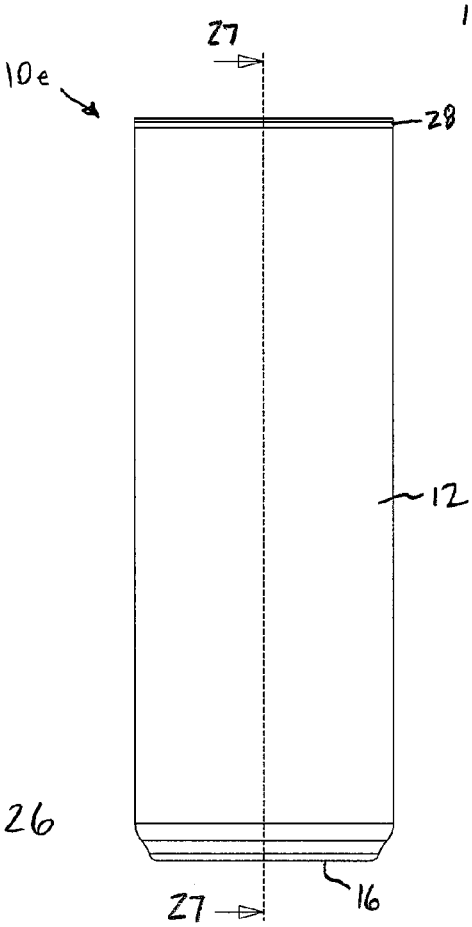
FIG. 26 is a side elevational view of the beverage container of FIG. 23.
Figure 27:
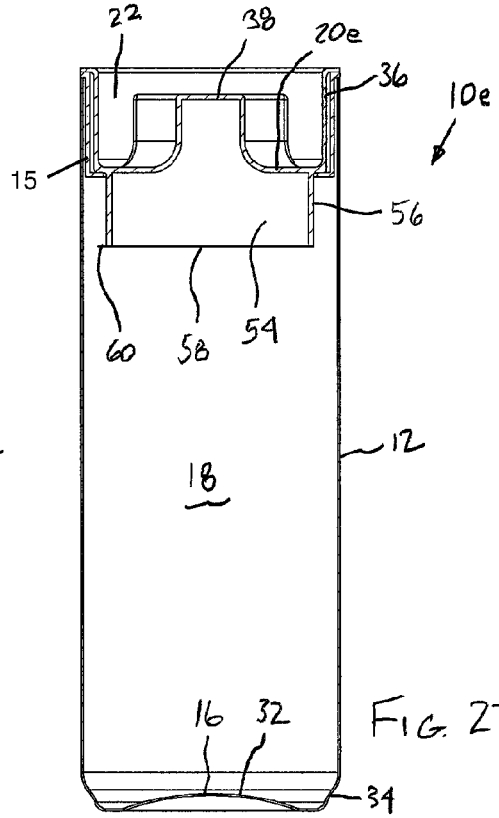
FIG. 27 is a cross sectional view of the beverage container of FIG. 23 taken along line 27-27 of FIG. 16.

FIGS. 18-22 show a fourth embodiment of a beverage container 10*d*. As shown in FIG. 19, removable cover 20*d* of beverage container 10*d* includes a stay-on-tab that comprises a tab 50 that acts as a lever to depress a lid 52, which folds downwardly and into the container 10. The tab 50 includes a pull portion 51*a* and a lever portion 51*b*. As shown in FIG. 21, in a preferred embodiment, the removable cover 20*d* is slanted. However, this is not a limitation on the present invention and the removable cover 20*d* can be horizontally oriented.

FIGS. 23-27 show a fifth embodiment of a beverage container 10*e*. Beverage container 10*e* is similar to beverage container 10*c*, but includes a secondary container 54 associated therewith. The secondary container 54 is preferably used for holding another beverage. For example, if the cylindrical main body portion 12 includes soda therein, the secondary container 54, which is initially separated from the remainder of the interior 18 can hold an alcoholic beverage. Or, in the alternative, the main body portion 12 can include an alcoholic beverage and the secondary container 54 can include a mixer. In a preferred embodiment, the secondary container 54 includes a wall 56 that extends downwardly from the removable cover 20*e* and a removable lid 58. In a preferred embodiment, the lid 58 includes a tab 60 that can be grasped to pull the lid 58 off, similar to a yogurt container. It will be appreciated that other methods for removing the lid 58 are within the scope of the present invention. For example, the lid can be screwed on the secondary container 54.

In use, a user removes the removable cover 20*e* (via threads 46 and 48), removes lid 58 and pours the beverage in the secondary container 54 into the cylindrical main body portion 12 to form a mixed drink. In a preferred embodiment, beverage container 10*e* includes ledge 42 to provide a sealing surface with removable cover 20*e*. However, this is not a limitation and ledge 42 can be omitted. It will be appreciated that this embodiment can be resealable. Furthermore, the secondary container 54 can be incorporated into any of the other removable covers described herein or any other type of removable cover known in the art.

As is best shown in FIGS. 5, 12, 17, 21 and 27, in the embodiments discussed above, the containers 10 can include a sleeve 15 received in the interior 18 of and concentric with the cylindrical main body portion 12. The sleeve 15 is positioned adjacent the top 14 of the cylindrical main body portion 12. In the embodiment shown in FIG. 17, the sleeve 15 includes threads 48 on the inside surface thereof. The threads 46 on the outside surface of the cylindrical wall 36 of the removable cover 20*c* are matingly engaged with the threads 48 on sleeve 15. In the embodiments that include a ledge 42 (see, e.g., FIG. 17), the ledge 42 extends inwardly from the bottom of the sleeve 15 and the bottom of the recessed removable cover 20*c* is in a sealing relationship with a top surface of the ledge 42. Furthermore, the ledge 42 defines a ledge opening 43.

It will be appreciated by those skilled in the art that the beverage containers 10 disclosed herein can replace standard size beverage containers or cans such that the containers 10 contain a standard volume of fluid ounces or milliliters of a beverage, but the extra volume created by recess 22 provides for the ability to add or introduce ice or other liquid into the container 10. For example, as shown in FIG. 5, the removable cover 20 is positioned at a location such that 12 fl. Oz. fit into the container 10*a* below the cover 20 (see arrow D1) and 4 fl. Oz. can fit above the cover 20 (see arrow D2). After the removable cover 20 is removed, ice or other liquid can be added as desired in any amount up to 4 fl. Oz. without worry of overflow.

Throughout the world different size or volume cans or containers are used for serving beverages. For example, in North America, the standard can size is 12 fl. Oz. or 355 ml. 16, 24 and 40 fl. Oz. are also standard. In Canada, the standard size is 355 ml, which is approximately equivalent to twelve fluid ounces. In Australia the standard can size is 375 ml. In China, India South Africa and Europe, the most common standard size is 330 ml. In some European countries 500 ml and 440 ml size cans are used. In Japan the most common standard sizes are 350 ml and 500 ml. In Korea, 250 ml cans are the most common for soft drinks. However, when accompanying take out food, a short 245 ml can is standard. Furthermore, throughout the world, the standard size of a "shot" of alcohol is different. Typically a shot can be anywhere between 1 fl. Oz. and 3 fl. Oz or 20 and 100 mL. Lastly, standard ice tray receptacles hold between about 1 and 2 fl. Oz. However, ice cubes can be smaller or larger. In a preferred embodiment, the beverage container 10 can hold the standard volume of beverage and has space thereabove for at least one shot of alcohol, two ice cubes or both.

Exemplary uses will now be explained. At sports arenas, beer is often sold from a kiosk or stand where the server opens a can of beer, pours it into a cup and hands the cup to the patron. The can is usually not given to the patron to drink from because of the possibility of dirt or dust on the top of the can. Therefore, this process requires materials for both the can and the cup. Further, the cup typically has the same general volume as the can. Therefore, the patron often spills some of the beer as he walks back to his seat (especially if he is carrying more than one cup). With the inventive container 10, the server can twist off or otherwise remove removable cover 20 and hand the container 10 to the patron. With the cover 20 gone, the patron essentially has a cup and with the extra space created by recess 22, spillage is less likely. If desired, the server can give the cover 20 to the patron so the container 10 can be resealed. Furthermore, the bevel 34 makes the containers 10 stackable, which further decreases spillage after the container 10 has been opened.

In another embodiment, the container can be filled with wine. Wine is more enjoyable when the top opening of the drinking container (e.g., wine glass) is large enough for a user's nose to fit therein. With traditional cans, this is not possible because of the small opening. Furthermore, wine drinkers often swirl the wine within the container to release the aroma. With the present invention, because the entire cover is removed and there is space created by recess 22, a user can both swirl the contents without worry of spillage and can fit his/her nose in the open top of the container.

It will be appreciated that modifications can be made to the embodiments described herein without deviating from the scope of the present invention. For example, the main body portion of the container can be a shape other than cylindrical or round, such as ovular, square, rectangular or the like, the removable cover can be secured in place in other manners, such as snap or press fit.

Unless the context clearly requires otherwise, throughout the description and the claims, the words "comprise," "comprising," and the like are to be construed in an inclusive sense, as opposed to an exclusive or exhaustive sense: that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. For example, while processes are presented in a given order, alternative embodiments may perform routines having steps in a different order, and some steps may be deleted, moved, added, subdivided, combined, and/or modified to provide alternative or subcombinations. Each of these processes may be implemented in a variety of different ways. Also, while processes are at times shown as being performed in series, these processes may instead be performed in parallel, or may be performed, at different times. Further any specific numbers noted herein are only examples: alternative implementations may employ differing values or ranges.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A beverage container comprising:

a cylindrical main body portion having an open top and a closed bottom and defining an interior, wherein the bottom includes a contact surface and a non-contact portion extending therebetween, wherein the bottom comprises a continuous concave non-contact portion surrounded by a contact surface, and wherein the cylindrical main body portion defines a first volume, a sleeve received in the interior of and concentric with the cylindrical main body portion, wherein the sleeve is positioned adjacent the top of the cylindrical main body portion, and wherein the sleeve includes threads on an inside surface thereof, a recessed removable cover that includes a bottom and a cylindrical wall extending upwardly therefrom, wherein the bottom of the recessed removable cover is positioned at a location between the bottom and the open top, and wherein the cylindrical wall includes threads on an outside surface thereof that are matingly engaged with the threads on the sleeve, and a recess defined between the bottom of the removable cover and the open top of the cylindrical main body portion, wherein the recess defines a second volume that is between about 5% and about 50% of the first volume.

2. The beverage container of claim 1 wherein the sleeve includes a rim disposed adjacent the top of the cylindrical main body portion, wherein the rim has a diameter that is greater than or equal to the diameter of the top of the cylindrical main body portion.

3. The beverage container of claim 1 wherein the non-contact portion does not include a convex portion.

4. The beverage container of claim 1 wherein the cylindrical wall of the removable cover includes a lip that extends outwardly from the cylindrical wall and covers at least a portion of the rim.

5. The beverage container of claim 4 wherein the removable cover includes a handle extending between opposing walls of the cylindrical wall.

6. The beverage container of claim 4 wherein the cylindrical main body portion has an inner circumference, and wherein the threads on the sleeve do not extend around the entire inner circumference thereof.

7. The beverage container of claim 1 wherein the second volume is between about 10% and about 40% of the first volume.

8. The beverage container of claim 1 wherein the second volume is between about 20% and about 30% of the first volume.

9. The beverage container of claim 1 wherein the removable cover is positioned at a location such that a standard volume of beverage can fill the first volume below the removable cover, and wherein the second volume is at least 20 mL

10. The beverage container of claim 1 wherein the removable cover further includes a secondary container associated therewith, wherein the secondary container includes a removable lid.

11. The beverage container of claim 10 wherein the cylindrical main body portion includes a first beverage in the interior thereof, wherein the secondary container includes a second beverage therein, and wherein the first and second beverages are separated by the removable lid.

12. The beverage container of claim 1 wherein the sleeve includes a ledge extending inwardly from a bottom thereof, wherein the bottom of the recessed removable cover is in a sealing relationship with a top surface of the ledge.

13. The beverage container of claim 12 wherein the ledge extends inwardly from the sleeve at an approximately perpendicular angle.

14. The beverage container of claim 11 wherein the sleeve includes a ledge extending inwardly from a bottom thereof, wherein the bottom of the recessed removable cover is in a sealing relationship with a top surface of the ledge.

15. The beverage container of claim 14 wherein the cylindrical wall of the removable cover defines a first outer diameter and the secondary container defines a second outer diameter, wherein the first outer diameter is greater than the second outer diameter, wherein the ledge defines a ledge opening, and wherein at least a portion of the secondary container extends through and below the ledge opening.

16. beverage container of claim 15 wherein the removable cover includes a handle extending between opposing walls of the cylindrical wall, wherein the secondary container defines a secondary container interior, and wherein a portion of the secondary container interior is defined in the handle.

17. The beverage container of claim 16 wherein the ledge extends inwardly from the sleeve at an approximately perpendicular angle.

18. The beverage container of claim 17 wherein the removable container includes a tab that enables a user to pull the removable lid from the secondary container.

* * * * *